US006966404B2

(12) United States Patent
Meeker

(10) Patent No.: US 6,966,404 B2
(45) Date of Patent: Nov. 22, 2005

(54) FOLDING STEP STOOL

(75) Inventor: Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/440,906

(22) Filed: May 19, 2003

(65) Prior Publication Data

US 2004/0231918 A1 Nov. 25, 2004

(51) Int. Cl.[7] ..... A47B 3/00
(52) U.S. Cl. ..... 182/33; 182/223; 108/132
(58) Field of Search ..... 182/222, 223, 182/33; 297/423.39, 423.41; 108/131, 132; D25/65; D6/349, 353; 248/239

(56) References Cited

U.S. PATENT DOCUMENTS

| | | | | | |
|---|---|---|---|---|---|
| 337,988 | A | * | 3/1886 | Palmer | 182/118 |
| 643,015 | A | * | 2/1900 | Thielmann | 108/133 |
| 1,203,783 | A | * | 11/1916 | Reischmann | 108/132 |
| 1,620,418 | A | * | 3/1927 | Wiarda | 248/439 |
| 1,823,871 | A | * | 9/1931 | Beasley | 182/155 |
| 2,572,474 | A | * | 10/1951 | Hamilton | 108/132 |
| 2,764,412 | A | * | 9/1956 | Dunham | 482/142 |
| 4,060,215 | A | * | 11/1977 | Burns et al. | 248/690 |
| 4,133,272 | A | * | 1/1979 | Naglowsky | 108/132 |
| 4,191,111 | A | * | 3/1980 | Emmert | 108/132 |
| 4,462,636 | A | * | 7/1984 | Markson | 297/423.41 |
| 4,471,969 | A | * | 9/1984 | Zabala et al. | 280/30 |
| D284,911 | S | * | 8/1986 | Lemmeyer | D6/349 |
| D354,859 | S | * | 1/1995 | Hsu | D6/368 |
| 5,762,163 | A | | 6/1998 | Kain | |
| 5,839,706 | A | * | 11/1998 | Liu | 248/188 |
| 5,937,968 | A | | 8/1999 | Gibson et al. | |
| 5,984,047 | A | * | 11/1999 | Rogers | 182/153 |
| 6,026,933 | A | | 2/2000 | King et al. | |
| 6,471,173 | B1 | * | 10/2002 | Tseng | 248/439 |
| 6,543,733 | B1 | * | 4/2003 | Pennington | 248/149 |
| 6,568,506 | B1 | * | 5/2003 | Donnalley | 182/223 |

* cited by examiner

*Primary Examiner*—Alvin Chin-Shue
(74) *Attorney, Agent, or Firm*—Barnes & Thornburg LLP

(57) ABSTRACT

A step stool includes a step and at least two legs coupled to the step. The step stool further includes a locking mechanism that, when activated, allows the legs to fold parallel to the step.

20 Claims, 5 Drawing Sheets

FOLDING STEP STOOL

BACKGROUND AND SUMMARY

The present disclosure relates to a step stool, and particularly to a folding step stool. More particularly, the present disclosure relates to a folding step stool having one step and legs configured such that they can be locked in an opened position by locking mechanisms.

Step stools have a step that people use for elevation when reaching for objects, painting walls, washing windows, or any everyday task where extra elevation would be helpful. Step stools are often foldable for ease of storage when the step is not being used.

According to the present disclosure, a folding step stool includes a step, a first folding leg, a second folding leg, and locking mechanisms. Each folding leg is coupled to the step for pivoting movement.

The step includes a top surface which may be formed to include a pair of apertures in a center portion of the top surface which cooperate to form a carrying handle to facilitate transport of the step stool. In some embodiments, the top surface transport handle may comprise, for example, at least one aperture, no apertures, or a handle coupled to the step surface. The top surface may further be formed to include non-skid means so that a user's foot will not slide when standing on the step. The step surface may further be formed to include an underside formed with a lattice of depending vertical surfaces to increase the rigidity and weight-bearing capacity of the step. Suitable materials for the step surface include high-density polyethylene (HDPE) or other low-cost, light-weight, high-strength materials.

In an opened position of the step stool, the first and second folding legs are arranged in a splayed, non-parallel relation to one another. In the opened position, the spacing between the first and second folding legs is wider at the bottom and narrower at the top for stability of the step stool. In a closed position of the step stool, the first and second folding legs are arranged in end-to-end relation to one another parallel to the step surface. In some embodiments, the first and second folding legs, or the right and left legs, may be generally A-shaped such that each leg is wider at the bottom than at its top.

In some embodiments, a cavity may be formed in an upper portion of each leg to receive a user's fingers for assistance in positioning the step stool for use. A lower portion of each leg may be formed in an inverted U-shape, thus forming two lower leg portions for contacting the ground or floor. An inner surface of the upper portion of each leg may be formed with a plurality of posts, flanges or projections, hereinafter referred to as posts. The posts are arranged to cooperate with a plurality of apertures formed on a side wall of the step surface. As an alternative, posts may be provided on the side walls of the step surface to engage apertures on the legs. In the opened position, the posts act to distribute vertical forces across the width of each leg, and further reduce stress on a leg pivot axis when, for example, a user is standing on the top surface of the step.

A leg lock assembly may comprise a locking bracket coupled to each leg to support each leg in a predetermined position upon pivoting movement of each leg relative to the step surface. The locking bracket may be slidably coupled to the underside of the step surface and pivotably coupled to its leg so that the leg can be moved relative to the step surface about a leg pivot axis between the opened use position to the closed storage position. The brackets are offset and each locking bracket is associated with one of the apertures formed in the top surface such that when the first and second folding legs are in end-to-end relation in the closed storage position, the locking brackets are arranged in a side-by-side relation.

Each locking bracket may further be provided with a colored tab which is visible in an associated indicator aperture formed in a platform covering at least a portion of the aperture formed in the top surface of the step. The colored tab will fill the indicator aperture when the locking bracket is correctly retained in a notch formed on the underside of the step.

When the first and second folding legs are moved to the closed storage position in an end-to-end relation, the inverted U-shaped lower portion of each leg cooperates to form an opening relative to the underside of the step. The opening provides clearance for the locking brackets when the first and second folding legs are in the closed storage position, thus reducing the profile of the closed step and providing a user access to each locking bracket.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
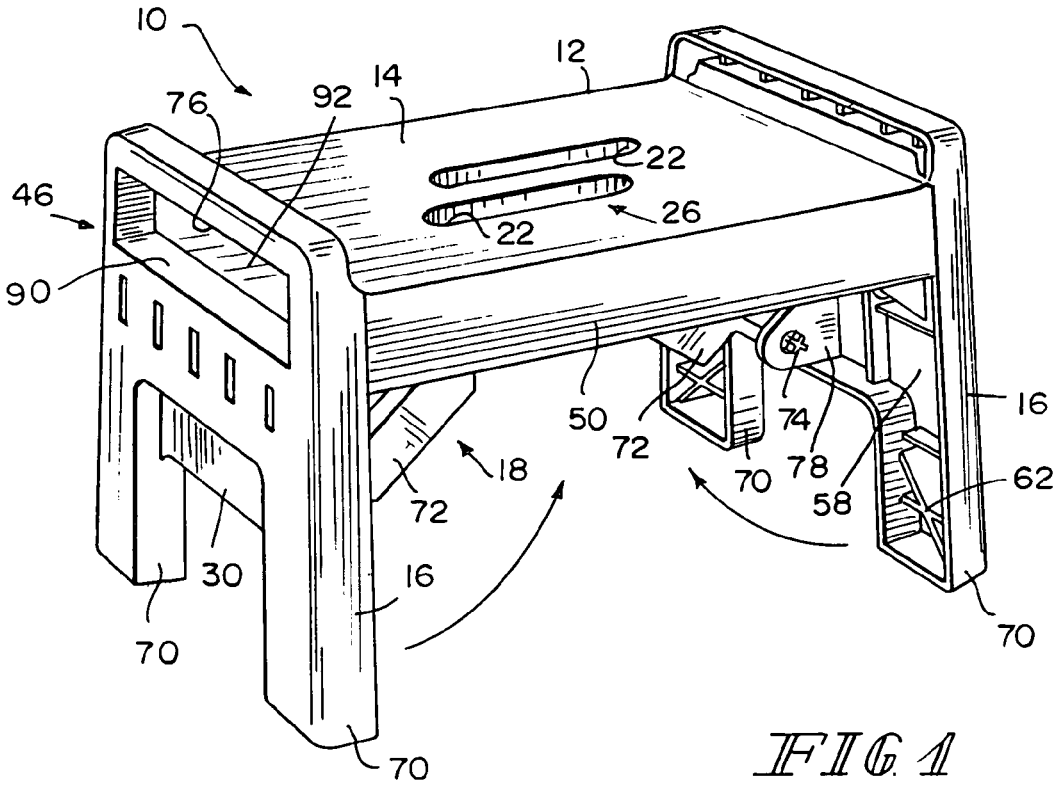
FIG. 1 is a perspective view of a folding step stool in accordance with the present disclosure showing a step stool assembly in a use position including a step having an upwardly facing step surface supported in a generally horizontal position by a right leg and a left leg.

A step stool 10 in accordance with this disclosure includes a step 12 with a top surface 14, a first and second folding leg 16, and a locking mechanism 18 as shown in FIG. 1. Each leg 16 is coupled for pivotable movement to step 12. A locking mechanism 18 is coupled to an underside 20 of the top surface 14 for slideable movement, and to leg 16 for pivotable movement. Each locking mechanism 18 provides means for locking and supporting its associated leg 16 so that the leg 16 remains locked in the opened use position.

Referring now to FIG. 1, step 12 is formed with a top surface 14. Top surface 14 is formed to include an oblong aperture 22 associated with a locking bracket 24. At least two oblong apertures 22, in offset, side-by-side relation, cooperate to form a transport handle 26 to allow a user to grasp the step stool 10 for ease of transport. Apertures 22 are situated on or near a central region of top surface 14.

Each aperture 22 is formed with a recessed inner surface 40 that covers at least a portion of aperture 22. Recessed inner surface 40 is further formed with a visual indicator 38. In an illustrative embodiment, as shown best in FIG. 10, visual indicator 38 is a rectangular aperture. Visual indicator 38 cooperates with a colored tab 42 formed on a portion of the locking bracket. When locking bracket 24 is in the locked position associated with the opened use position of the associated leg 16, colored tab 42 is completely visible indicating that a user can safely mount step 12 for use. In some embodiments top surface 14 is further formed with a non-skid surface to prevent slippage of a user's foot when standing on step 12.

As shown best in FIG. 4, underside 20 is formed with a plurality of transversely oriented rib walls 62 extending below underside 20 giving the underside of step 12 a "waffled" appearance. Rib walls 62 act to reinforce step 12 and make it more rigid.

Figure 9:
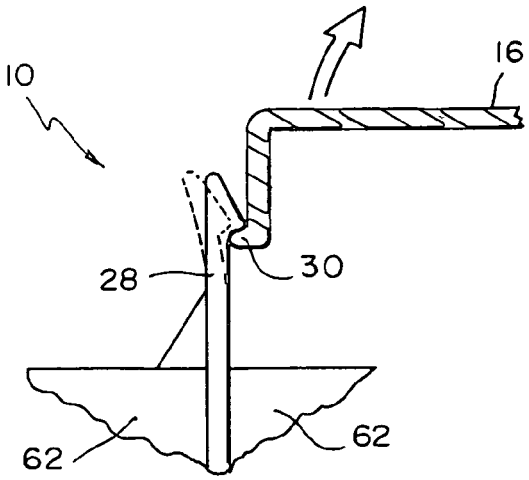
FIG. 9 is a fragmentary sectional view, with portions broken away, similar to FIGS. 5–8 showing a leg retention tang, depending from a downwardly facing surface of the step, securing a lip portion formed on the leg to secure it in the storage position.

The following description, in some cases, will deal only with one leg 16 and its associated locking bracket 24, but it will be appreciated that both legs 16 and their brackets 24 operate in the same fashion. Folding legs 16 are arranged in end-to-end relation to one another parallel to step 12 in the closed storage position as shown, for example, in FIG. 2. Each leg 16 is retained in the closed storage position by a leg retention tang 28 depending from the underside 20 of step 12 which cooperates with a lip 30 formed on a lower portion of each leg 16, as shown in FIG. 9. In the opened use position, each leg 16 is coupled for pivotable movement to an opposite end of a parallelogram formed by step 12. As shown in FIG. 1, the lower portion of each leg 16 is formed in an inverted U-shape so that two lower leg portions 70 are formed on each leg 16 to contact the ground or floor.

Each leg 16 is further formed with an upper portion 46, a lower portion 70, and an inner surface 58. Upper portion 46 is formed with a finger-receiving cavity 76, and further formed with a side wall 90 and an inner wall 92. Each cavity 76 provides a user with means for positioning step stool 10 when first and second leg 16 are moved to the opened use position. Inner wall 92 is further formed including an aperture 86 situated on a central region, shown in FIG. 3, so that a user is able to hang step stool 10, for example, on a hook for ease of storage. In an illustrative embodiment, inner surface 58 is formed with a plurality of transversely oriented rib walls 62 giving the inner surface of legs 16 a "waffled" appearance. Rib walls 62 act to reinforce legs 16 and make them more rigid.

Figure 5:
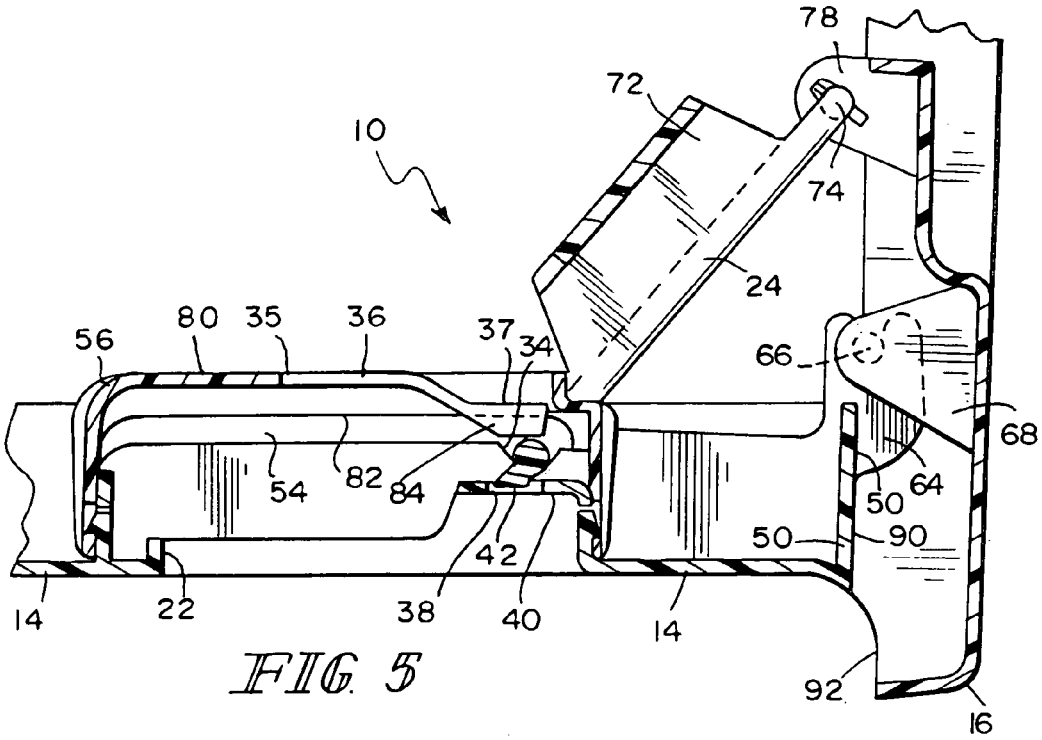
FIG. 5 is a fragmentary sectional view, with portions broken away, taken along line 5—5 of FIG. 3 showing an upper end of the locking bracket nested in the retention notch, and the right leg unfolded into the use position.
Figure 6:
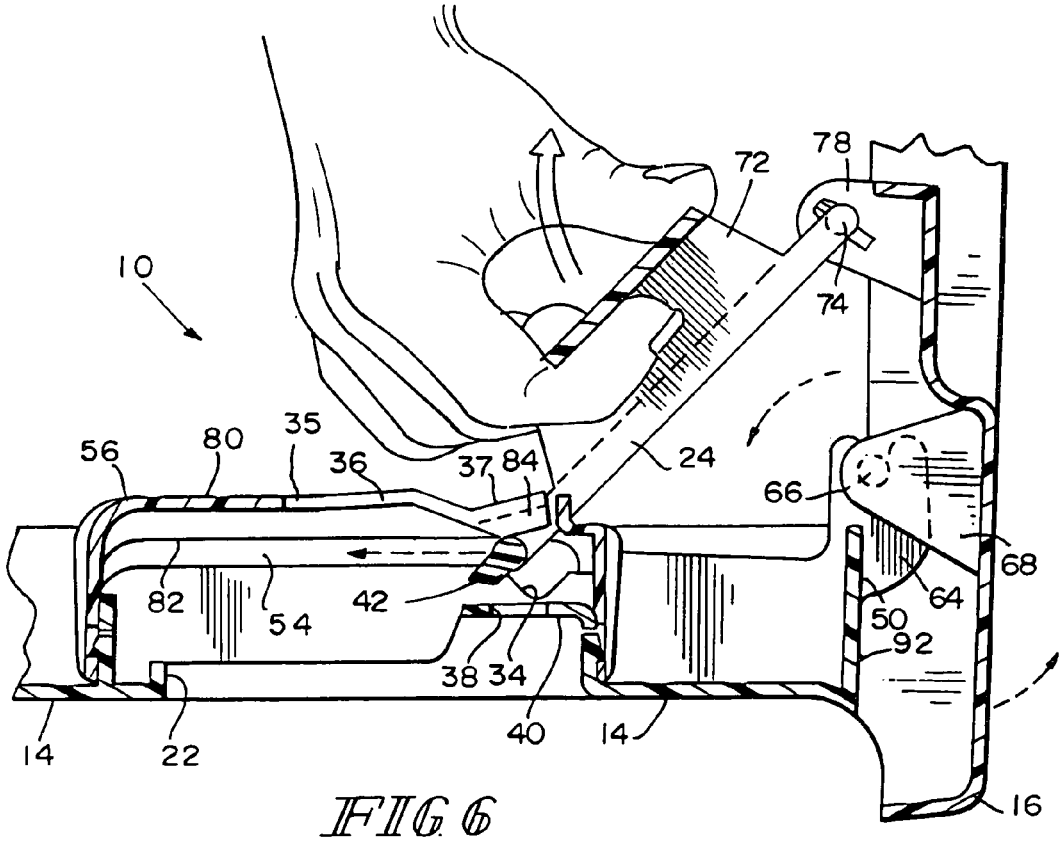
FIG. 6 is a fragmentary sectional view, with portions broken away, similar to FIG. 5 showing a user moving the upper end of the locking bracket from the nested position in the retention notch to the storage position within a guide channel.

Referring now to FIGS. 5 and 6, step 12 is further formed with a side wall 50 depending from the perimeter of top surface 14. A plurality of pivot brackets 64 is arranged in spaced-apart relation and depend from a lower edge of side wall 50. Each pivot bracket 64 is associated with a plurality of pivot posts 66 formed between two triangular flanges 68 coupled in perpendicular relation to the inner surface 58 of each leg 16. Pivot posts 66 are received by pivot brackets 64 to form leg pivot axis 32. Two outer pivot brackets 65, of the plurality of pivot brackets 64, are formed with a substantially annular-shaped opening, slightly smaller in diameter than pivot posts 66. In this arrangement, pivot brackets 65 provide means to securely retain pivot posts 66 so that legs 16 are able to pivot about pivot axis 32. The remaining pivot brackets 64 are formed with a generally U-shaped opening to allow pivotable movement of pivot posts 66.

Figure 2:
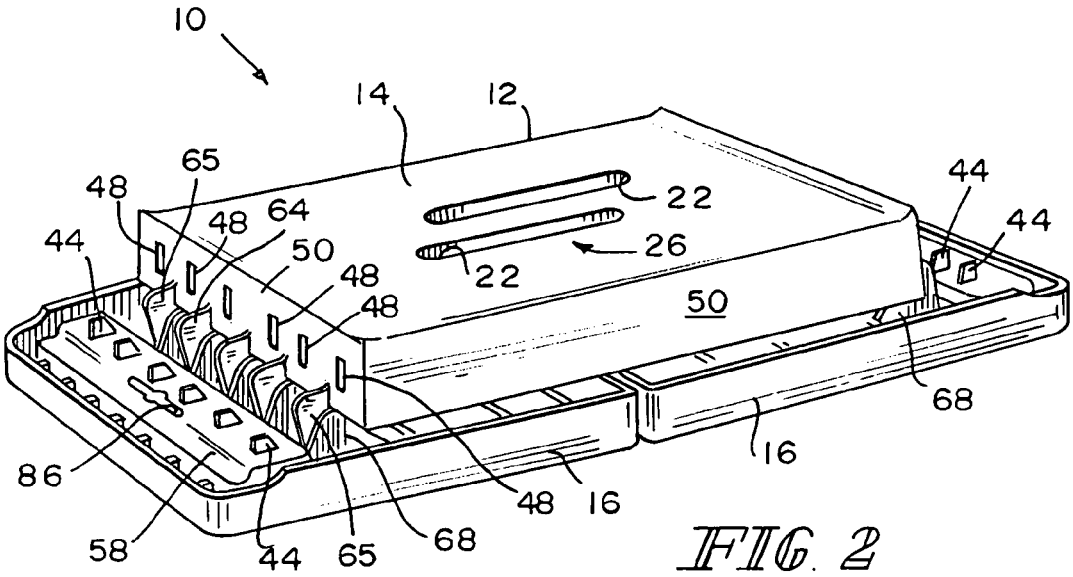
FIG. 2 is a perspective view of the folding step stool assembly of FIG. 1 in a storage position with a lower portion of the right and left legs moved relative to each other to a parallel registered relationship with the step.
Figure 7:
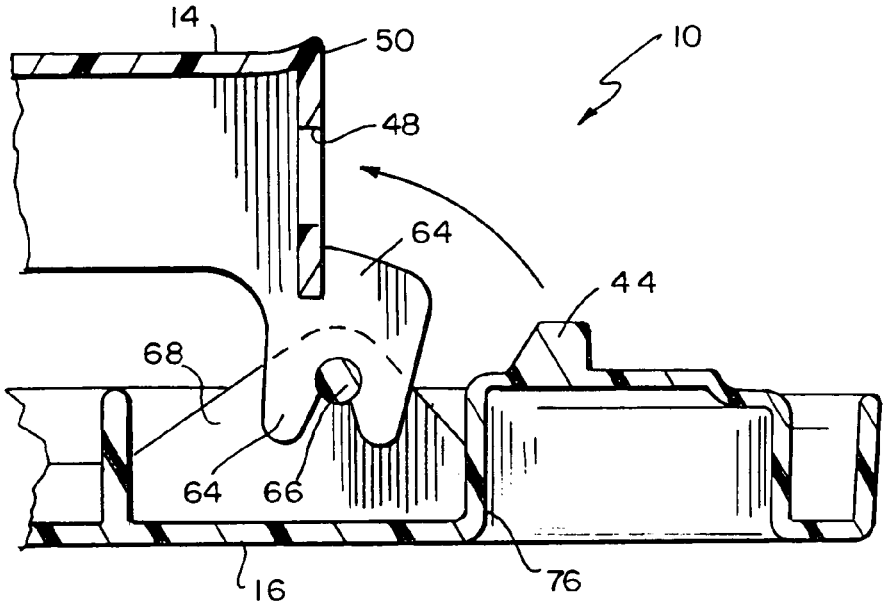
FIG. 7 is a fragmentary sectional view, with portions broken away, similar to FIGS. 5 and 6 showing a leg hinge coupled to a leg hinge post to permit movement of the leg from the storage position to the use position.
Figure 8:
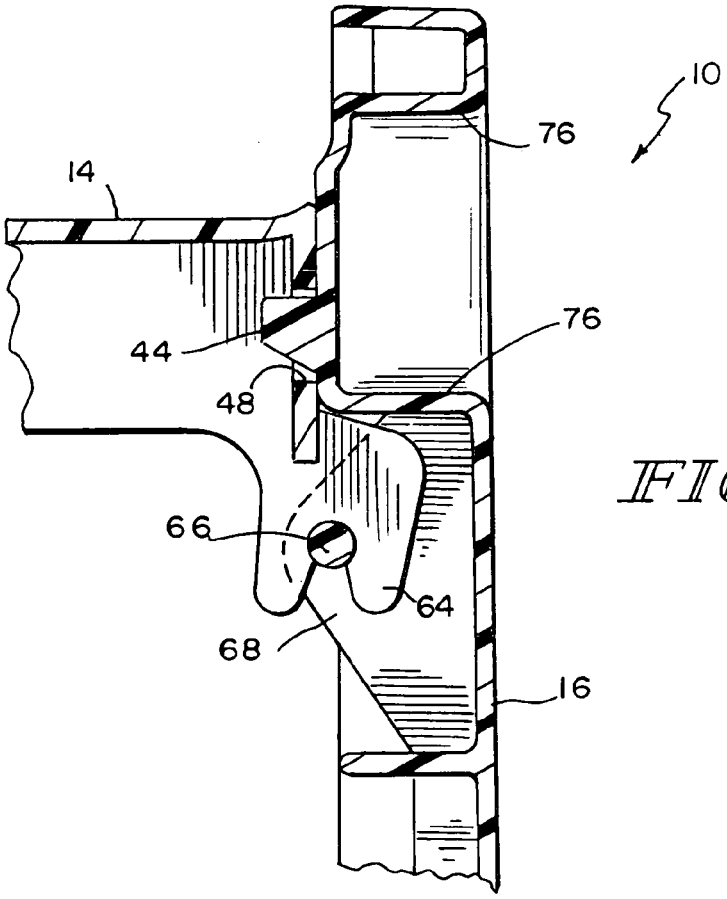
FIG. 8 is a fragmentary sectional view, with portions broken away, similar to FIGS. 5–7 showing the leg hinge coupled to the leg hinge post, and the leg moved to the use position with a support post of the leg received by a post-receiving aperture formed in a side wall of the step.

As shown best in FIGS. 2, 7 and 8, each leg 16 includes a plurality of support posts 44 in spaced-apart relation coupled to an upper portion 46 of an inner surface 58 of the leg 16. Each support post 44 is received by and engages into an associated post-receiving aperture 48, formed in side wall 50 of step 12, when leg 16 is moved to the opened use position. Support posts 44 provide means to distribute vertical loads from step 12 along the width of each leg 16 so that stability of step stool 10 is enhanced when, for example, a user is standing on top surface 14.

Figure 3:
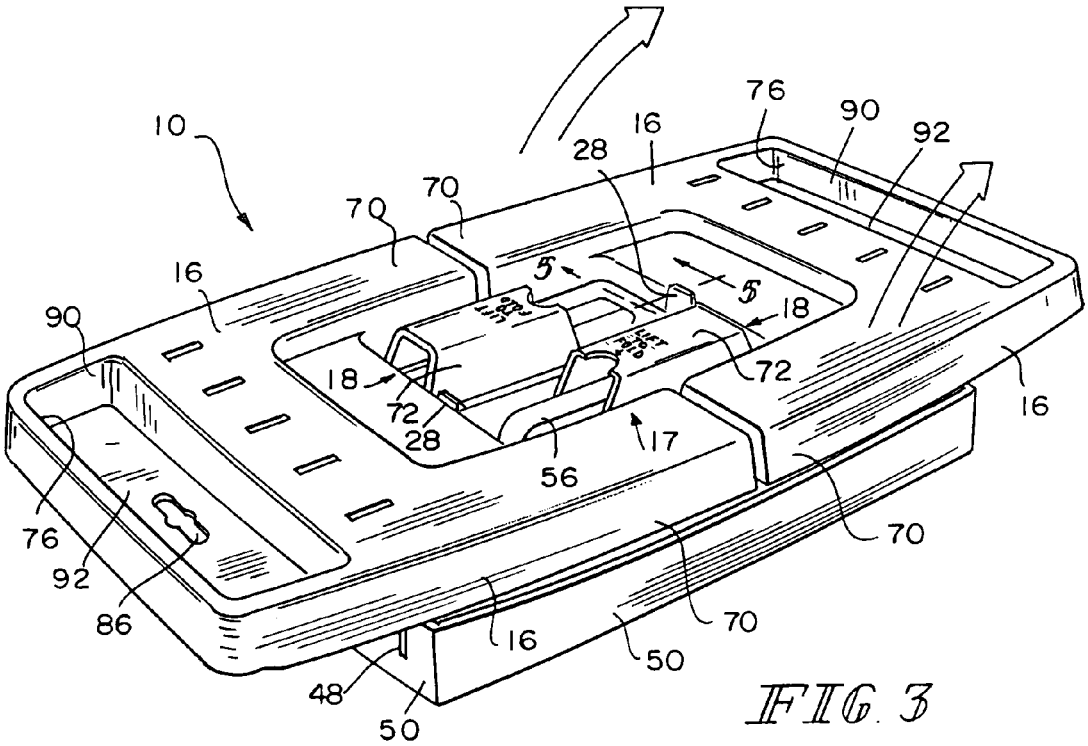
FIG. 3 is a bottom perspective view of the folding step stool assembly of FIG. 1 showing the steps folded in the storage position, a number of locking brackets, and the motion of the leg to assume the use position.

In an illustrative embodiment as shown best in FIG. 3, when step stool 10 is in the closed storage position first and second legs 16 cooperate to form an opening 17 to underside 20. Opening 17 provides clearance for the locking mechanisms 18 when step stool 10 is in the closed storage position where brackets 24 are arranged in parallel relation to underside 20. As seen in FIG. 3, brackets 18 are arranged in parallel relation, e.g., portion of the two brackets are equally spaced apart as they extend along substantially the same line.

Figure 4:
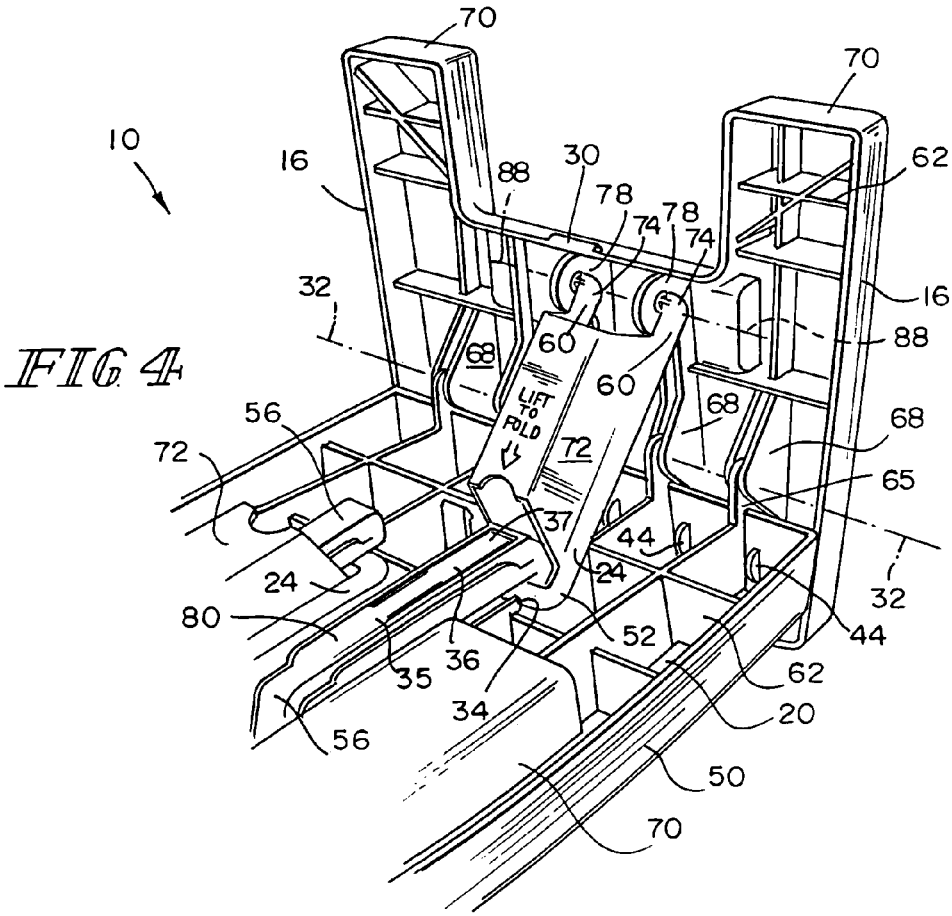
FIG. 4 is a partial perspective view with portions broken away of the right leg in the use position, with the locking bracket nested in a retention notch under a guiding lock rail and the left leg in the storage position.

Referring now to FIG. 4, the illustrative locking mechanism 18 includes locking bracket 24, a guiding rail 56 which cooperates with a portion of the transversely oriented rib walls 62 of underside 20 to form a guide channel 54, and a plurality of retention notches formed on underside 20. In an illustrative embodiment, bracket 24 is substantially tubular in shape. When step stool 10 is in the opened use position, bracket 24 is arranged in a locked support position. In the locked support position, a first end 52 of locking bracket 24 nests in retention notches 34 and is retained by a keeper 36 which acts to retain a portion of locking bracket 24 in retention notches 34. Locking bracket 24 is further formed with a finger-receiving enclosure 72. Finger-receiving enclosure 72 provides means for a user to disengage the portion of locking bracket 24 retained in notches 34 so that each leg 16 is able to pivot about its pivot axis 32 while simultaneously allowing slidable movement of a portion of bracket 24 along guide channel 54 when the leg 16 is moved by a user to the closed storage position. Enclosure 72 covers at least a portion of the opening formed by locking bracket 24.

Referring now to FIGS. 4-6, guiding rail 56 is mounted to the underside 20 of step 12 generally along the longitudinal axis of aperture 22. At least a portion of guiding rail 56 depends from and is parallel to underside 20 thus forming guide channel 54. Guiding rail 56 is further formed with S-shaped keeper 36. A first end 35 of keeper 36 is coupled to and coplanar with a first surface 80 of guiding rail 56. A second end 37 of keeper 36 is arranged in parallel relation with a second surface 82 and adjacent to underside 20 of step 12. A second end 37 of keeper 36 is further formed with a plurality of cantilevered beams 84 arranged to abut or confront a portion of locking bracket 24 when first end 52 of bracket 24 is received in notches 34. It will be appreciated that, while guiding rail 56 is illustrated and described, the sliding function for the end of the bracket 24 may be provided by a variety of types of track or guide structures that may be attached to or formed as part of the step 20.

As shown in FIGS. 4 and 5, a slide member provided by a first end 52 of locking bracket 24 is arranged in guide channel 54 for slidable movement upon movement of each leg 16 relative to step 12. A pivot mount 74 provided by a second end 60 of locking bracket 24 is coupled for pivotable movement to an inner surface 58 of each leg 16. Second end 60 forms an open end of locking bracket 24. Pivot mount 74 of bracket 24, associated with the open end of the locking bracket, is arranged in perpendicular relation to bracket 24. Each pivot mount 74 is coupled for pivotable movement to a flange 78, thus forming pivot axis 88, and arranged in perpendicular relation to the inner surface 58 of each leg 16.

Referring now to FIG. 6, a user begins movement of each leg 16 from the opened use position to the closed storage position by pulling upward on finger-receiving enclosure 72 which disengages a portion of locking bracket 24 from the received position in retention notches 34, and allows slidable movement of locking bracket 24 along guide channel 54. Simultaneously, locking bracket 24 begins pivoting movement at second end 60 coupled to leg 16, and leg 16 begins pivoting on axis 32 relative to step 12. When each leg 16 is moved to the closed storage position in parallel relation to step 12, leg retention tang 28 contacts lip 30 to secure each leg 16 in the closed storage position.

Figure 10:
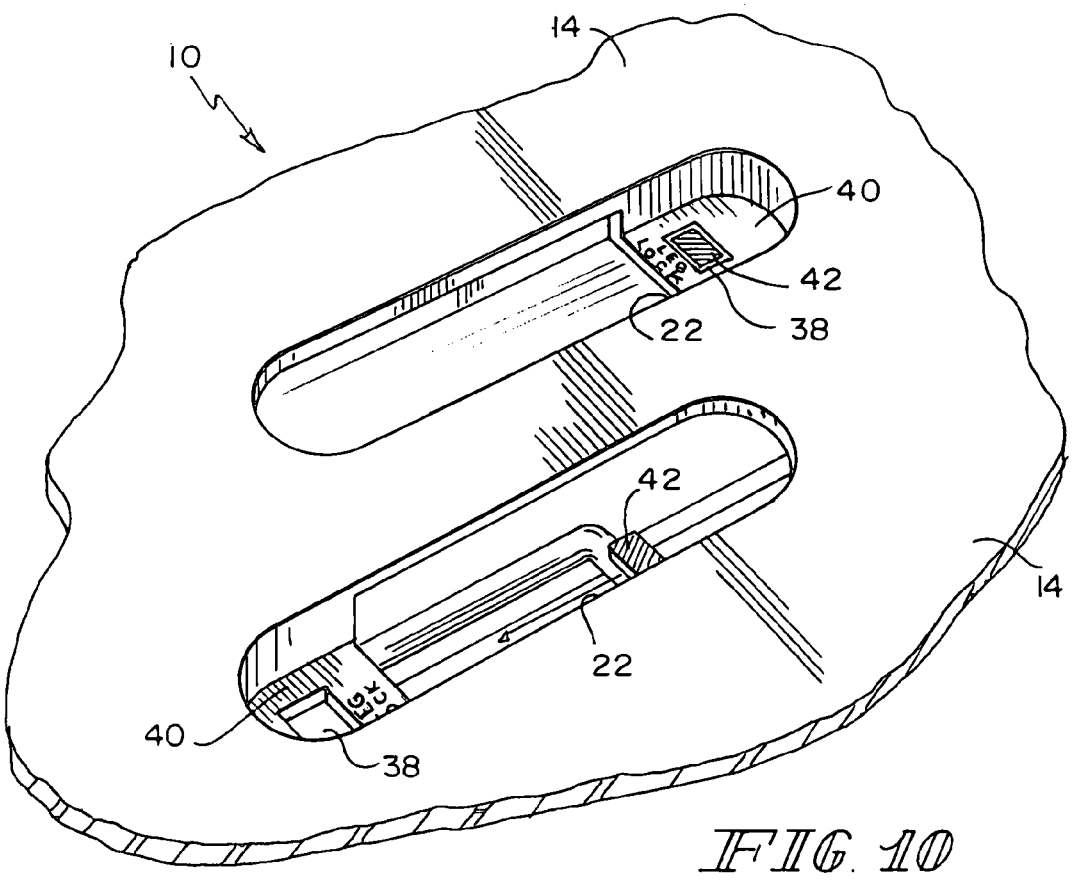
FIG. 10 is a perspective view, with portions broken away, of the upwardly facing step surface of FIG. 1 showing finger-receiving apertures formed in the step surface cooperating to form a transport handle, and a visual lock indicator formed on an upwardly facing recessed surface that covers at least a portion of the finger-receiving aperture.

Referring now to FIG. 10, when locking bracket 24 is in the locked support position, a visual lock indicator 38 formed in a recessed platform 40 cooperates with a lock indicator tab 42 formed on a portion of locking bracket 24 to indicate that bracket 24 is in the proper locked support position so that step 12 is ready for use.

Step stool 10 according to the present disclosure may be fabricated from a variety of materials which may be formed into the desired configuration. For example, in some embodiments of step stool 10, step 12, and each leg 16, are each made of one-piece plastic construction. In such embodiments, support posts 44 may be formed integrally with each leg 16. Likewise, each pivot bracket 64 may be formed integrally with step 12. Suitable plastic materials include thermoplastics, high-density polyethylene, polyvinyl chloride, polypropylene, acrylics, and the like. Top surface 14 may be made from a material that is the same as or different from the material from which other portions of the associated step are made. Portions of step 12, leg 16, and locking mechanism 18 may be made from metal, composite materials, fiber glass, fiber board, cardboard, paper board, or any other type of material having suitable strength and/or desirable aesthetic characteristics. Different portions of step stool 10 may be made from different materials. For example, step 12 may be made from plastic materials while locking mechanism 18 is fabricated from metal.

Although the disclosure has been described in detail with reference to certain preferred embodiments, variations, and modifications exist within the scope and spirit of the disclosure as described and as defined in the following claims.

What is claimed is:

1. A step stool comprising, a step including a top surface and an underside, a first leg and a second leg, each leg pivotably coupled to the step, each leg having an upper portion, a lower portion, an inner surface and an outer surface, and the legs being arranged in end-to-end relation to one another parallel to the step in a closed storage position and arranged in a spaced apart non-parallel relation to one another upon movement of each leg to an opened use position, and a leg lock assembly for each leg, the lock assembly including a locking bracket, wherein the locking bracket includes a lower end coupled to the inner surface of each leg and an upper end to the underside of the coupled step, the locking brackets are arranged in parallel relation to one another when the legs are in the closed storage position and further configured to retain each leg in a fixed position relative to the step upon movement of each leg to the opened use position, wherein the top surface has an aperture formed therein which includes a recessed platform that covers at least a portion of the aperture and the top surface is further formed to include a visual indicator aperture that cooperates with one of the locking brackets to display a portion of the locking bracket in the visual indicator aperture when the locking bracket is in a locked position upon movement of the legs to the opened use position.

2. A step stool comprising, a step including first and second ends, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg is arranged to lie alongside the first end of the step and a closed storage position wherein the lower portion of the first leg lies alongside an underside of the step and the upper portion of the first leg extends in a first direction away from the lower portion of the first leg beyond the first end of the step to overhang the first end of the step, a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is arranged to lie alongside the second end of the step and a closed storage position wherein the lower portion of the second leg lies alongside the underside of the step and in confronting relation to the lower portion of the first leg and the upper portion of the second leg extends in a second direction opposite to the first direction beyond the second end of the step to overhang the second end of the step and to cause the step to lie in a region located between the upper portions of the first and second legs, wherein the first end is formed to include a post-receiving aperture and the first leg further includes a support post coupled to the upper portion of the first leg and arranged to be received by and engage into the post-receiving aperture formed in the first end when the first leg is moved to the opened use position, and wherein the first leg mount includes an outer pivot bracket coupled to the first end and arranged to extend in the first direction away from the first end and the mid-portion of the first leg includes a flange arranged to mate with the outer pivot bracket to establish the first pivot axis.

3. The step stool of claim 2, wherein the first outer pivot bracket is located between the support post and the lower portion of the first leg.

4. A step stool comprising, a step including first and second ends, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg is arranged to lie alongside the first end of the step and a closed storage position wherein the lower portion of the first leg lies alongside an underside of the step and the upper portion of the first leg extends in a first direction away from the lower portion of the first leg beyond the first end of the step to overhang the first end of the step, and a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is arranged to lie alongside the second end of the step and a closed storage position wherein the lower portion of the second leg lies alongside the underside of the step and in confronting relation to the lower portion of the first leg and the upper portion of the second leg extends in a second direction opposite to the first direction beyond the second end of the step to overhang the second end of the step and to cause the step to lie in a region located between the upper portions of the first and second legs, wherein the first end is formed to include a plurality of spaced-apart post-receiving apertures, the first leg includes a plurality of support posts, and each support post is arranged to be received by and engaged into a companion one of the post-receiving apertures formed in the first end when the first leg is moved to the opened use position to distribute vertical loads applied to the step along a width of the first leg, and wherein the first leg mount includes a plurality of pivot brackets coupled to the first end and arranged to extend in the first direction away from the first end, each pivot bracket is arranged to lie in a space between each pair of adjacent post-receiving apertures formed in the first end, the mid-portion of the first leg includes a plurality of flanges, and each flange is arranged to mate with a companion one of the pivot brackets to establish the first pivot axis.

5. The step stool of claim 4, wherein each of the flanges extend downwardly away from the first end and the top surface to cause the first end to lie in a space between the top surface and the first pivot axis.

6. A step stool comprising, a step including first and second ends, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg is arranged to lie alongside the first end of the step and a closed storage position wherein the lower portion of the first leg lies alongside an underside of the step and the upper portion of the first leg extends in a first direction away from the lower portion of the first leg beyond the first end of the step to overhang the first end of the step, and a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is arranged to lie alongside the second end of the step and a closed storage position wherein the lower portion of the second leg lies alongside the underside of the step and in confronting relation to the lower portion of the first leg and the upper portion of the second leg extends in a second direction opposite to the first direction beyond the second end of the step to overhang the second end of the step and to cause the step to lie in a region located between the upper portions of the first and second legs, wherein the lower portion of the first leg includes a first lip, the step includes a first leg retention tang depending from an underside of the step to extend away from the top surface of the step, and the first leg retention tang mates with the first lip to retain the first leg in the closed storage position upon movement of the first leg to the closed storage position, and wherein the lower portion of the first leg includes a U-shaped side wall and the first lip is cantilevered to the U-shaped side wall.

7. A step stool comprising, a step including first and second ends, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg is arranged to lie alongside the first end of the step and a closed storage position wherein the lower portion of the first leg lies alongside an underside of the step and the upper portion of the first leg extends in a first direction away from the lower portion of the first leg beyond the first end of the step to overhang the first end of the step, and a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is arranged to lie alongside the second end of the step and a closed storage position wherein the lower portion of the second leg lies alongside the underside of the step and in confronting relation to the lower portion of the first leg and the upper portion of the second leg extends in a second direction opposite to the first direction beyond the second end of the step to overhang the second end of the step and to cause the step to lie in a region located between the upper portions of the first and second legs further comprising a first leg locking mechanism associated with the first leg, wherein the first leg locking mechanism includes a guiding rail coupled to the step to form a guide channel therebetween, the step being formed to include a retention notch opening into the guide channel, and a locking bracket including a pivot mount coupled to the first leg for pivotable movement about an axis and a slide member arranged in the guide channel for slidable movement back and forth therein during pivotable movement of the pivot mount about the axis to cause the slide member to nest in the retention notch upon movement of the first leg to the opened use position and to cause the slide member to exit the retention notch upon movement of the first leg to the closed storage position.

8. The step stool of claim 7, wherein the first locking mechanism further includes a keeper coupled to the guiding rail and configured yieldably to retain the slide mount in the retention notch upon movement of the first leg to the opened use position.

9. The step stool of claim 8, wherein the first locking mechanism further includes a finger-receiving enclosure providing means for a user to disengage the slide mount from the retention notch in opposition to a biasing force applied by the keeper to the slide member so that the first leg is able to pivot about the first pivot axis while simultaneously allowing slidable movement of the slide mount along the guide channel when the first leg is moved by a user to the closed storage position.

10. The step stool of claim 7, wherein the first locking mechanism further includes a finger-receiving enclosure providing means for a user to disengage the slide mount from the retention notch so that the first leg is able to pivot about the first pivot axis while simultaneously allowing slidable movement of the slide mount along the guide channel when the first leg is moved by a user to the closed storage position.

11. The step stool of claim 7, further comprising a second leg locking mechanism associated with the second leg, wherein the second leg locking mechanism includes a second guiding rail coupled to the step to form a second guide channel therebetween and arranged to lie in spaced-apart parallel relation to the guiding rail included in the first leg locking mechanism, the step being formed to include a second retention notch opening into the second guide channel, and a second locking bracket including a second pivot mount coupled to the second leg for pivotable movement about another axis and a second slide member arranged in the second guide channel for slidable movement back and forth therein during pivotable movement of the second pivot mount about said another axis to cause the second slide member to nest in the second retention notch upon movement of the second leg to the opened use position to cause the second slide member to exit the second retention notch upon movement of the second leg to the closed storage position.

12. A step stool comprising, a step including first and second ends, each of the first and second ends being formed to include a post-receiving aperture, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg lies alongside the first end of the step and a closed storage position wherein the lower portion of the first leg lies alongside an underside of the step, the first leg further including a support post coupled to the upper portion of the first leg and received by and engaged into the post-receiving aperture formed in the first end when the first leg is moved to the opened use position, and a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is lies alongside the second end of the step and a closed storage position wherein the lower portion of the second leg lies alongside the underside of the step, the second leg further including a support post coupled to the upper portion of the second leg and received by and engaged into the post-receiving aperture formed in the second end when the second leg is moved to the opened use position, wherein the first end is formed to include a plurality of spaced-apart post-receiving apertures, the first leg includes a plurality of support posts, and each support post is arranged to be received by and engaged into a companion one of the post-receiving apertures formed in the first end when the first leg is moved to the opened use position to distribute vertical loads applied to the step along a width of the first leg, and wherein the first leg mount includes a plurality of pivot brackets coupled to the first end and arranged to extend in the first direction away from the first end, each pivot bracket is arranged to lie in a space between each pair of adjacent post-receiving apertures formed in the first end, the mid-portion of the first leg includes a plurality of flanges, and each flange is arranged to mate with a companion one of the pivot brackets to establish the first pivot axis.

13. The step stool of claim 12, wherein each of the flanges extend downwardly away from the first end and the top surface to cause the first end to lie in a space between the top surface and the first pivot axis.

14. A step stool comprising, a step including first and second ends, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg is arranged to lie alongside the first end of the step and a closed storage position wherein the lower portion of the first leg lies alongside an underside of the step and the upper portion of the first leg extends in a first direction away from the lower portion of the first leg beyond the first end of the step to overhang the first end of the step, and a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is arranged to lie alongside the second end of the step and a closed storage position wherein the lower portion of the second leg lies alongside the underside of the step and in confronting relation to the lower portion of the first leg and the upper portion of the second leg extends in a second direction opposite to the first direction beyond the second end of the step to overhang the second end of the step and to cause the step to lie in a region located between the upper portions of the first and second legs, wherein the lower portion of the first leg includes a first lip, the step includes a first leg retention tang depending from an underside of the step to extend away from the top surface of the step, and the first leg retention tans mates with the first lip to retain the first leg in the closed storage position upon movement of the first leg to the closed storage position, wherein the lower portion of the second leg includes a second lip, the step includes a second leg retention tang depending from and underside of the step to extend away form the top surface of the step, and the second leg retention tang mates with the second lip to retain the second leg in the closed storage position upon movement of the second leg to the closed storage position, and wherein the lower portion of the first leg includes a U-shaped side wall and the first lip is cantilevered to the U-shaped side wall.

15. A step stool comprising, a step including first and second ends, each of the first and second ends being formed to include a post-receiving aperture, a top surface located between the first and second ends, a first leg mount coupled to the first end, and a second leg mount coupled to the second end, a first leg including an upper portion, a ground-engaging lower portion, and a mid-portion located between the upper and lower portions of the first leg, the mid-portion of the first leg being mounted on the first leg mount for pivotable movement relative to the step about a first pivot axis between an opened use position wherein the upper portion of the first leg lies alongside the first end of the step and a closed storage position wherein the lower portion of the first leg lies alongside an underside of the step, the first leg further including a support post coupled to the upper portion of the first leg and received by and engaged into the post-receiving aperture formed in the first end when the first leg is moved to the opened use position, a second leg including an upper portion, a ground-engaging lower portion, and a mid-portion located between the upper and lower portions of the second leg, the mid-portion of the second leg being mounted on the second leg mount for pivotable movement relative to the step about a second pivot axis between an opened use position wherein the upper portion of the second leg is lies alongside the second end of the step and a closed storage position wherein the lower portion of the second leg lies alongside the underside of the step, the second leg further including a support post coupled to the upper portion of the second leg and received by and engaged into the post-receiving aperture formed in the second end when the second leg is moved to the opened use position, and further comprising a first leg locking mechanism associated with the first leg, the first leg locking mechanism including a guiding rail coupled to the step to form a guide channel therebetween and a locking bracket, the step being formed to include a retention notch opening into the guide channel, the locking bracket including a pivot mount coupled to the first leg for pivotable movement about an axis and a slide member arranged in the guide channel for slidable movement back and forth therein during pivotable movement of the pivot mount about the axis to cause the slide member to nest in the retention notch upon movement of the first leg to the opened use position and to cause the slide member to exit the retention notch upon movement of the first leg to the closed storage position.

16. The step stool of claim 15, wherein the first end is formed to include a post-receiving aperture and the first leg further includes a support post coupled to the upper portion of the first leg and arranged to be received by and engage into the post-receiving aperture formed in the first end when the first leg is moved to the opened use position.

17. The step stool of claim 15, wherein the locking mechanism further includes a keeper coupled to the guiding rail and configured yieldably to retain the slide mount in the retention notch upon movement of the first leg to the opened use position.

18. The step stool of claim 17, wherein the locking mechanism further includes a finger-receiving enclosure providing means for a user to disengage the slide mount from the retention notch in opposition to a biasing force applied by the keeper to the slide member so that the first leg is able to pivot about the first pivot axis while simultaneously allowing slidable movement of the slide mount along the guide channel when the first leg is moved by a user to the closed storage position.

19. The step stool of claim 15, wherein the locking mechanism further includes a finger-receiving enclosure providing means for a user to disengage the slide mount from the retention notch so that the first leg is able to pivot about the first pivot axis while simultaneously allowing slidable movement of the slide mount along the guide channel when the first leg is moved by a user to the closed storage position.

20. The step stool of claim 15, further comprising a second leg locking mechanism associated with the second leg, wherein the second leg locking mechanism includes a second guiding rail coupled to the step to form a second guide channel therebetween and arranged to lie in spaced-apart parallel relation to the guiding rail included in the first leg locking mechanism, the step being formed to include a second retention notch opening into the second guide channel, and a second locking bracket including a second pivot mount coupled to the second leg for pivotable movement about another axis and a second slide member arranged in the second guide channel for slidable movement back and forth therein during pivotable movement of the second pivot mount about said another axis to cause the second slide member to nest in the second retention notch upon movement of the second leg to the opened use position to cause the second slide member to exit the second retention notch upon movement of the second leg to the closed storage position.

* * * * *